US009888777B2

(12) United States Patent
Lin

(10) Patent No.: US 9,888,777 B2
(45) Date of Patent: Feb. 13, 2018

(54) FOLDABLE BENCH

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd., Zhuhai (CN)

( * ) Notice: Subject to any disclaimer, the term of this patent is extended or adjusted under 35 U.S.C. 154(b) by 127 days.

(21) Appl. No.: 15/050,890

(22) Filed: Feb. 23, 2016

(65) Prior Publication Data

US 2017/0099950 A1 Apr. 13, 2017

Related U.S. Application Data

(63) Continuation-in-part of application No. 29/541,705, filed on Oct. 7, 2015, now Pat. No. Des. 785,354.

(51) Int. Cl.

| | |
|---|---|
| ***A47C 4/00*** | (2006.01) |
| ***A47C 4/10*** | (2006.01) |
| ***A47C 4/04*** | (2006.01) |
| ***A47C 11/00*** | (2006.01) |
| ***A47C 7/16*** | (2006.01) |
| *A47C 4/20* | (2006.01) |

(52) U.S. Cl.

CPC ..... *A47C 4/04* (2013.01); *A47C 7/16* (2013.01); *A47C 11/005* (2013.01); *A47C 4/10* (2013.01); *A47C 4/20* (2013.01)

(58) Field of Classification Search

CPC .. A47C 4/10; A47C 4/12; A47C 4/283; A47C 4/286; A47C 4/34; A47C 4/44; A47C 4/46; A47C 4/20; A47C 4/22; A47C 4/045; A47C 4/02; A47C 4/16; A47C 9/105; A47B 39/06

See application file for complete search history.

(56) References Cited

U.S. PATENT DOCUMENTS

| | | | | |
|---|---|---|---|---|
| 370,265 | A * | 9/1887 | Lambkin | A47C 4/10 297/60 |
| 417,819 | A | 12/1889 | Gage | |
| 475,368 | A | 5/1892 | Welch | |
| 1,146,358 | A | 7/1915 | Slatter et al. | |
| 1,163,263 | A | 12/1915 | Rudduck | |
| 1,198,509 | A | 9/1916 | Anderson | |

(Continued)

*Primary Examiner* — Joshua J Michener
*Assistant Examiner* — Kyle J. Walraed-Sullivan
(74) *Attorney, Agent, or Firm* — Luedeka Neely Group PC

(57) ABSTRACT

A foldable bench having a seat and front support members that may be rotated between a folded position and an unfolded position includes a backrest, first and second front support members, a seat, and a latch. The front support members are mounted to the font of the backrest and rotate laterally between a folded and unfolded position. The seat is mounted to the front of the backrest and rotates vertically between a folded and unfolded position. In the folded position, the seat is sandwiched between the backrest and the front support members. In the unfolded position, the seat prevents the front support members from rotating inwards to the folded position. The seat is supported in an unfolded position by seat supports located on each of the front support members, which are received by receivers in the seat. A latch located on one of the arms selectively engages an opening in the seat to secure the seat in the unfolded position.

12 Claims, 15 Drawing Sheets

(56) References Cited

U.S. PATENT DOCUMENTS 1,420,095 A * 6/1922 Gutter ..... A47C 4/10 297/44
2,098,711 A * 11/1937 Rastetter ..... A47C 4/10 297/59
2,541,036 A * 2/1951 Christensen ..... A47C 4/10 297/47
2,541,131 A * 2/1951 Thal ..... A47C 4/10 297/47
3,120,976 A * 2/1964 Van Syoc ..... A47C 4/20 108/132
3,381,998 A * 5/1968 Cheshier ..... A47C 4/20 297/124
3,890,814 A 6/1975 Fantoni
4,179,143 A 12/1979 Shy
4,597,599 A 7/1986 Bisbing
4,699,406 A 10/1987 Swanson, Jr.
5,390,999 A * 2/1995 Fuller ..... A47B 83/008 297/377
5,593,192 A 1/1997 Stuchinsky
5,819,670 A 10/1998 O'Connor et al.
6,131,992 A * 10/2000 Chang ..... A47C 4/20 297/55
6,149,240 A * 11/2000 Pietrzak ..... A47C 7/16 297/440.1
6,213,545 B1 * 4/2001 Chun-Yueh ..... A47C 4/20 297/39
6,217,111 B1 * 4/2001 Tseng ..... A47C 4/20 297/35
6,270,156 B1 * 8/2001 Metzger ..... A47C 9/105 297/16.2
6,874,850 B2 * 4/2005 Berkowicz ..... A47C 1/124 211/13.1
6,953,221 B1 * 10/2005 Tseng ..... A47C 3/04 297/23
D785,354 S * 5/2017 Lin ..... D6/368
2002/0190559 A1 * 12/2002 Phillips ..... A47C 1/023 297/337
2006/0186712 A1 * 8/2006 Lu ..... A47C 4/20 297/58
2007/0029846 A1 * 2/2007 Cohen ..... A47C 4/20 297/16.1
2010/0213801 A1 * 8/2010 Ceballos-Godefroy . A47B 3/00 312/249.8
2011/0101764 A1 * 5/2011 van Hekken ..... A47C 3/00 297/452.1
2012/0187741 A1 * 7/2012 Kumazawa ..... A47C 7/16 297/463.1
2012/0233767 A1 * 9/2012 Liu ..... A47K 3/122 4/578.1
2012/0267920 A1 * 10/2012 Voris ..... A47C 4/045 297/16.1
2012/0286544 A1 * 11/2012 Cohen ..... A47C 4/46 297/30
2012/0313402 A1 * 12/2012 Aldred ..... A47C 4/20 297/16.1
2014/0300144 A1 10/2014 Voris
2017/0099950 A1 * 4/2017 Lin ..... A47C 4/04

* cited by examiner

FOLDABLE BENCH

RELATED APPLICATIONS

This application claims priority as a continuation-in-part of U.S. patent application Ser. No. 29/541,705, filed Oct. 7, 2015, titled "Foldable Bench."

FIELD

This disclosure relates to the field of furniture. More particularly, this disclosure relates to furniture, including benches and chairs, having foldable sides and seats.

SUMMARY

The above and other needs are met by a foldable chair with a backrest, front support members rotatably mounted to the backrest configured to rotate between a folded position where the first front support member is disposed adjacent to the backrest and an unfolded position where the first front support member extends outwardly from the backrest, and a seat extending between the front support members and rotatably mounted to the backrest and configured to rotate between a folded position where the seat is disposed adjacent to the backrest and an unfolded position where the seat extends outwardly from the backrest. A first seat support extends from an inside surface of the first front support member. A first receiver is located on a side surface of the seat and engages the first seat support when the seat is rotated to the unfolded position for supporting the seat in the unfolded position. A latch including a latch extension is mounted to a front support member. A latch receiver is located in a side surface of the seat and is configured to receive the latch extension when the seat is in the unfolded position to prevent the seat from rotating with respect to the backrest.

In certain embodiments, a second seat support extends from an inside surface of the second front support member. A second receiver is located on a side surface of the seat and is configured to engage the second seat support when the seat is rotated to the unfolded position for supporting the seat in the unfolded position. The first front support member may include a first front leg and a substantially horizontal lower rail having a first end that is rotatably mounted to the first side of the backrest and a second end that is fixedly mounted to the first front leg. The second front support member may include a second front leg and a substantially horizontal lower rail having a first end that is rotatably mounted to the second side of the backrest and a second end that is fixedly mounted to the second front leg. The first and second front legs are configured to contact a ground surface. In some embodiments, the first front support and the second front support each have an arm rest and a lower horizontal rail that is rotatably mounted to corresponding upper and lower first and second extensions extending outwards from the backrest. A rotating latch may be mounted to a bottom surface of the lower horizontal rail of the first or second front support member.

The first seat support may be mounted to a bottom surface of the lower horizontal rail of the first front support member. The foldable chair may also include a second seat support mounted to a bottom surface of the lower horizontal rail of the second front support member. A second receiver located on a side surface of the seat engages the second seat support when the seat is rotated to the unfolded position for supporting the seat in the unfolded position. The first and second seat supports may each form an elongate L having a top and a side connected together at an angle. The top of each seat support being mounted to the bottom surface of the lower horizontal rail of the respective front support member. The side of each seat support mounted to a rearward-facing surface of the respective front leg.

In certain embodiments, the seat includes a seat support frame and a seat top mounted to a top surface of the seat support frame. The seat support frame extends between the first and second front support members. It is rotatably mounted to the backrest and is configured to rotate vertically between the folded position and the unfolded position. The seat support frame has a first side and a second side and an open middle defined by front and back members, a first side member and a second side member connected to the front and back members proximate the first and second side, respectively. At least one middle support member is connected to the front and back members and is located between the first and second side members. The seat top may be formed from blow molded plastic. The seat top may include one or more downward projections that may be connected to the seat support frame by connectors that pass through seat support frame and into the downward projection to connect the seat support frame to the seat top. For example, a first downward projection of the seat top may extend into the middle of the support frame between the first side member and the first middle support. Also, a second downward projection of the seat top may extend into the middle of the support frame between the second side member and the second middle support. Connectors pass the middle supports and into the downward projection to connect the seat support frame to the seat top.

In certain embodiments, the front support members are rotatably mounted to first and second extensions extending outwards from the backrest. An inside corner of the first and second extensions may be rounded to facilitate rotation of support members with respect to the extensions. The front supports may each have an arm rest and a lower horizontal rail that is rotatably mounted to corresponding upper and lower first and second extensions extending outwards from the backrest.

In certain embodiments, the latch is a rotating latch and the latch extension is configured to selectively engage the latch receiver when the latch is rotated. The latch receiver may be an opening disposed in a side surface of the seat configured to receive the latch extension.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
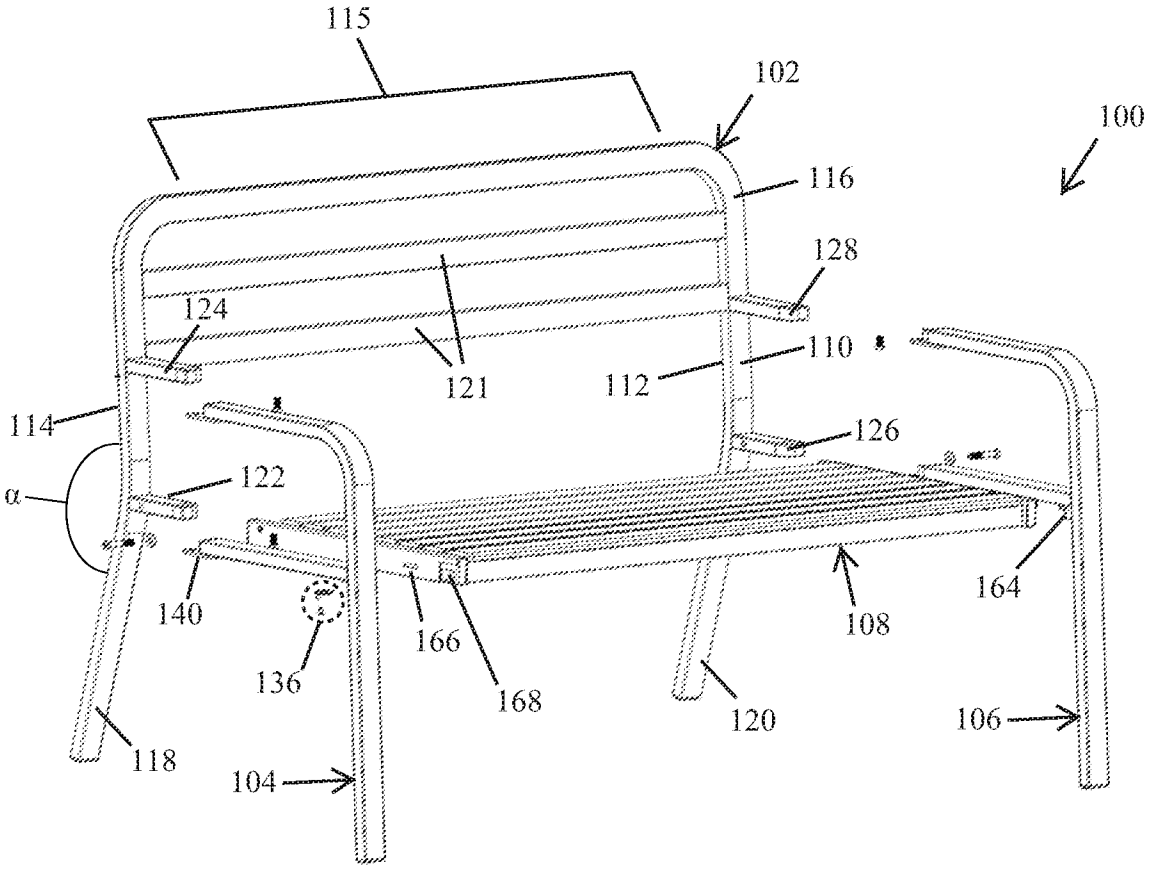
FIG. 1 is a front exploded view of a foldable bench in an unfolded configuration according to an embodiment of the present invention.
Figure 2:
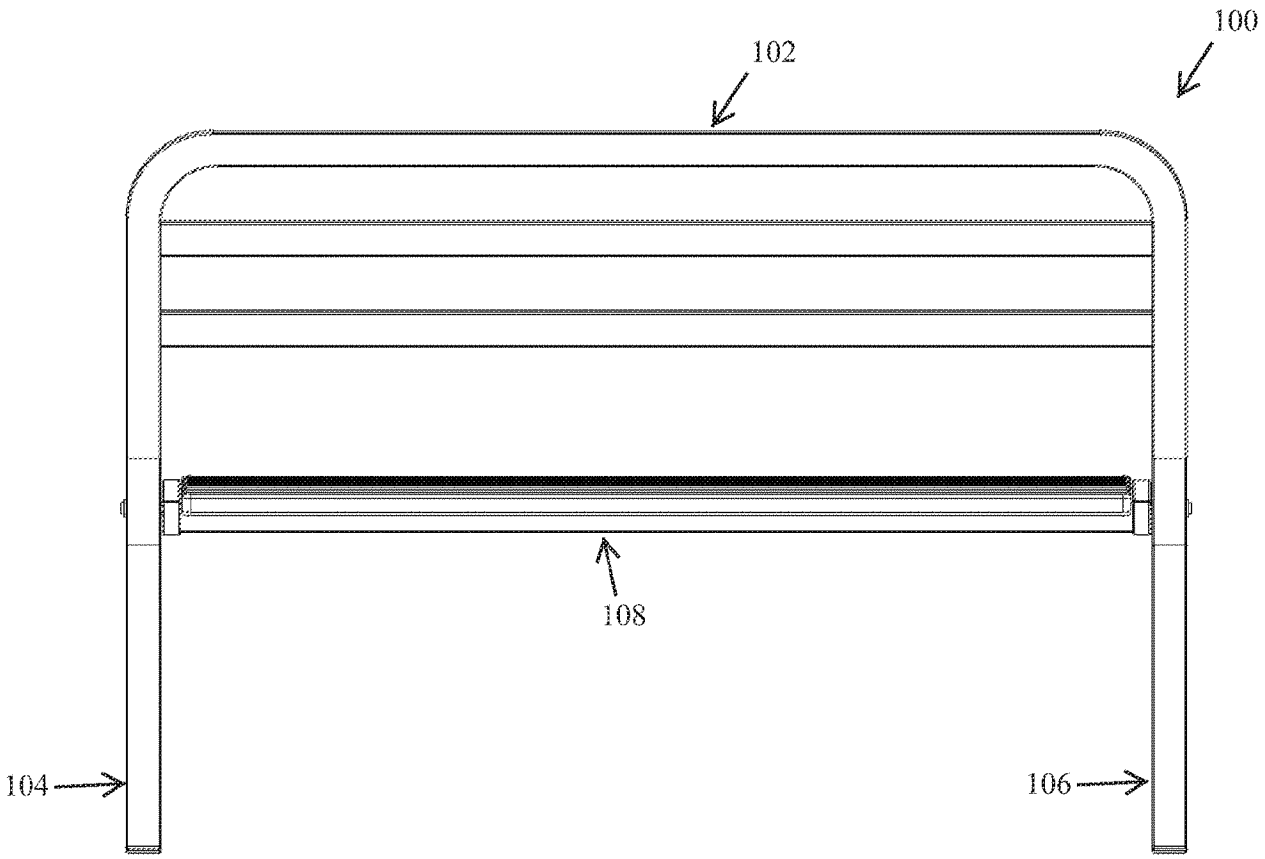
FIG. 2 is a front elevation view of a foldable bench in an unfolded configuration according to an embodiment of the present invention.

In the description that follows, various embodiments of a foldable bench are described. The terms "chair", "bench" or "seat" or other similar terms may be used in this description interchangeably. FIGS. 1-7 provide various views of a bench 100 according to an embodiment of the present invention shown in an unfolded position for use. FIGS. 8-17 provide various views of the bench 100 in a folded position for storage.

The bench 100 includes generally a backrest 102, a first front support member 104 and a second front support member 106 that are mounted to the backrest, and a seat 108 that is located between the front support members and that is mounted to the backrest. The front support members 104, 106 are rotatably mounted to the backrest and can rotate laterally inwards to a folded position where the front support members are substantially parallel with the backrest or outwards to an unfolded position where the front support members are substantially perpendicular to the backrest. The seat 108 is connected to the backrest 102 and is vertically rotatable between a vertical folded position and a horizontal unfolded position. When the seat 108 is unfolded, it prevents the front support members 104, 106 from rotating inwards to the folded position. Furthermore, as discussed in more detail below, the seat may be prevented from rotating upwards by a latch 136. On the other hand, in the folded position, the front support members 104, 106 prevent the seat 108 from rotating downwards. To deploy the bench 100, the front support members 104, 106 are first rotated outwards to the unfolded position and then the seat 108 is rotated downwards and latched in the unfolded position. To stow the bench 100, the latch 136 is disengaged from the seat 108, the seat 108 is rotated upwards towards the backrest 102 and then the front support members 104, 106 are rotated inwards.

The backrest 102 has a front surface 110, a back surface 112, a first side 114, a second side 116 and a middle 115 located between the first and second sides. In this particular embodiment, the backrest 102 is formed in an inverted U-shape that includes an upper section 102A where an occupant's back might rest while occupying the bench 100 and a lower section 102B that includes first and second rear legs 118, 120. The upper section 102A may have a number of horizontal ribs 121 that extend between the first and second sides 114, 116 of the backrest 102 to strengthen the backrest 102 as well as make it more comfortable for an occupant. Alternatively, the ribs 121 may be replaced by a solid or partially solid back section for contacting an occupant's back.

The upper and lower sections 102A, 102B may be joined together at an angle $\alpha$ that may be between 135° and 180°. Preferably the angle $\alpha$ is approximately 160-175°. While the upper section 102A is substantially vertical, the lower section 102B is angled slightly outwards behind the rear of the bench 100 so that the rear legs are angled rearwardly away from the back surface 112 in order to give the bench additional stability and to prevent it from turning over.

Figure 8:
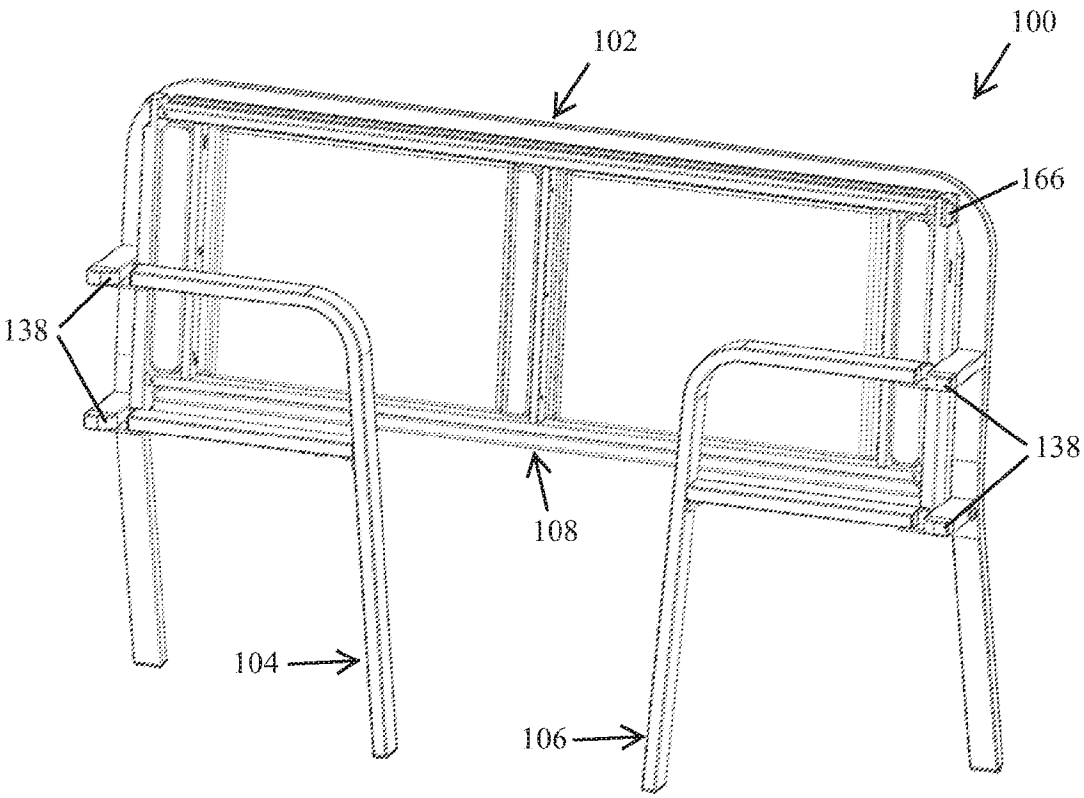
FIG. 8 is a front perspective view of a foldable bench in a folded configuration according to an embodiment of the present invention.
Figure 9:
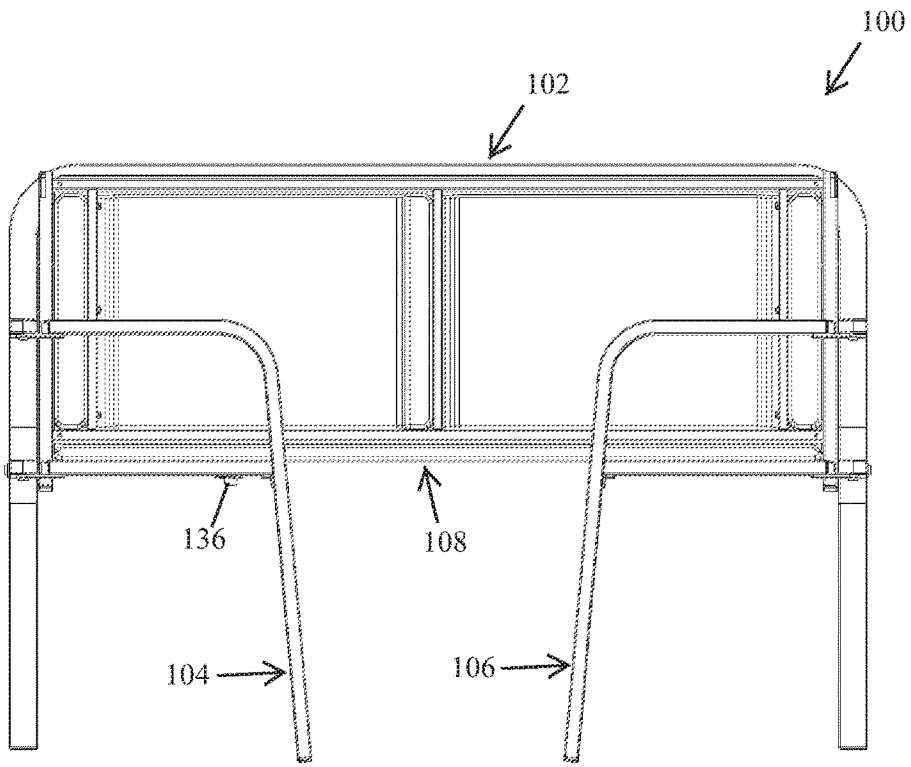
FIG. 9 is a front elevation view of a foldable bench in a folded configuration according to an embodiment of the present invention.
Figure 10:
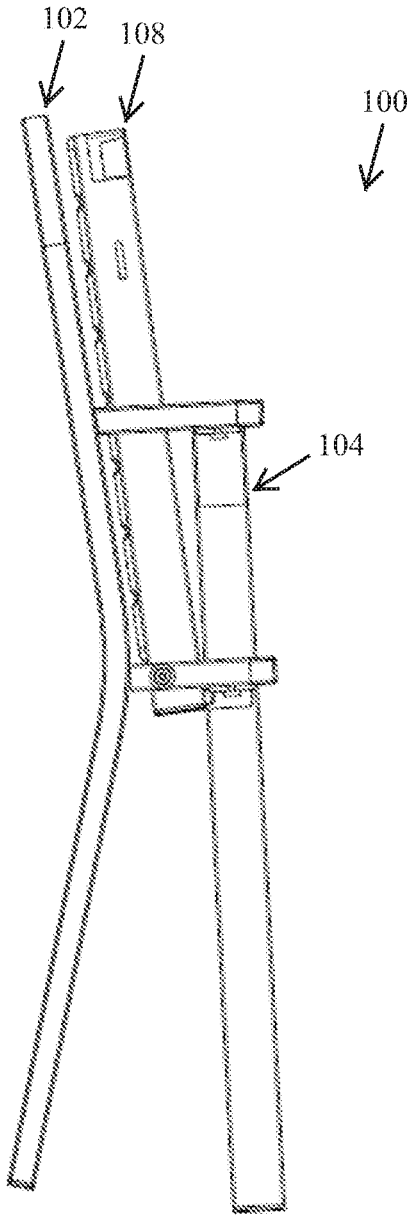
FIG. 10 is a left side elevation view of a foldable bench in a folded configuration according to an embodiment of the present invention.
Figure 11:
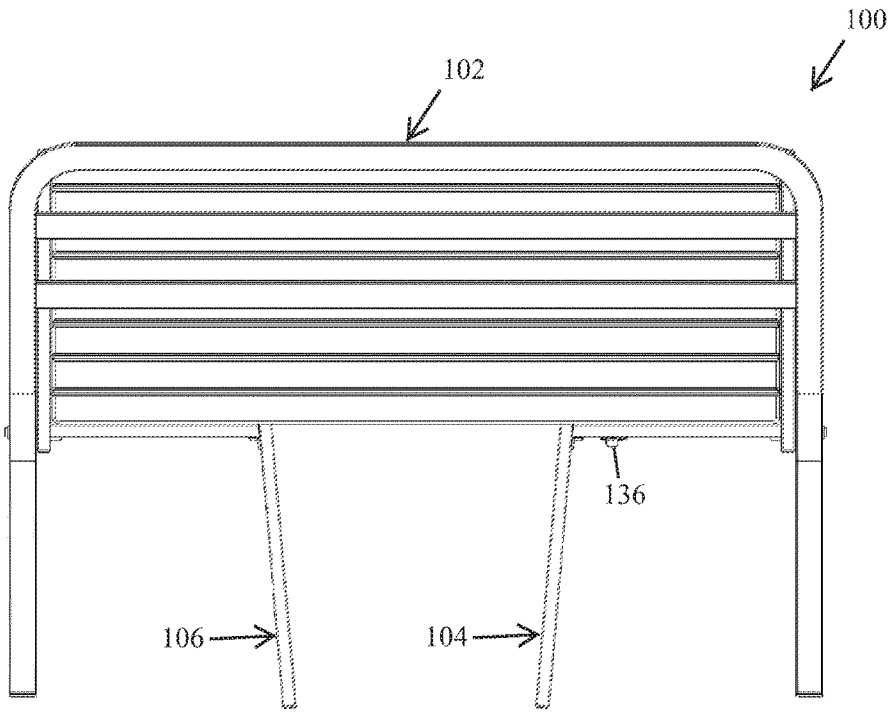
FIG. 11 is a rear elevation view of a foldable bench in a folded configuration according to an embodiment of the present invention.
Figure 12:
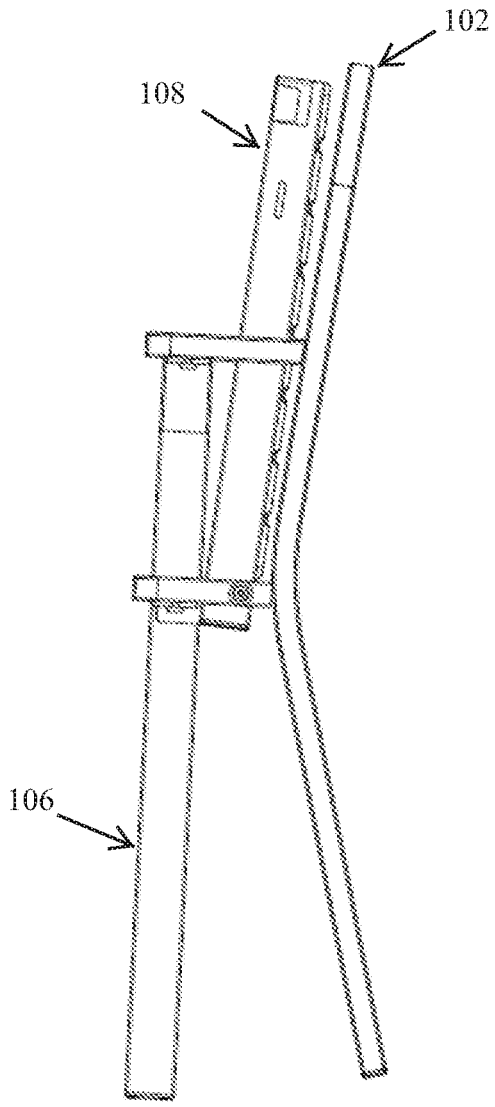
FIG. 12 is a right side elevation view of a foldable bench in a folded configuration according to an embodiment of the present invention.

The front support members 114, 116 are preferably configured such that the front surface 110 of the backrest 102 includes one or more mounting locations for mounting to the front support members. In this particular embodiment, lower and upper left extensions 122, 124 and lower and upper right extensions 126, 128 are located on the front surface 110 near the first and second sides 114, 116 of the backrest 102. The extensions 122, 124, 126, 128 extend outwards from the backrest 102 and provide convenient mounting locations for the first and second front support members 104, 106 as well as the seat 108. The first and second front support members 104, 106 are rotatably mounted to extensions 122, 124, 126, 128 and may rotate inwards to the folded position, as depicted in FIG. 8, or outwards to an unfolded position, as depicted in FIG. 1. An inside corner 138 of each of the extensions 122, 124, 126, 128 is rounded to facilitate the rotation of the front support members 104, 106 between the unfolded and folded positions.

The front support members 104, 106 include mounting locations that correspond with the mounting locations of the backrest 102. In the embodiment shown, the first and second front support members 104, 106 each include a lower rail 130 having a first end 130A that is rotatably mounted to the lower left extension 122 or lower right extension 126. A mounting plate 140 is fixedly secured to a bottom surface of the lower rail 130. A threaded connector 142 passes through an opening in the mounting plate 140 and is then secured in a threaded opening located in a bottom surface of the lower left and right extensions 122, 126. A second end 130B of the lower rail 130 is fixedly mounted to a vertical leg 132 of the front support member 104. One end of the vertical leg 132 contacts the ground. The opposite end of the vertical leg 132 extends upwards past the lower rail 130 and is joined to an armrest 134. In this particular embodiment, the intersection between the leg 132 and the armrest 134 is rounded for added safety and comfort of the occupant. The armrest 134 has a first end 134A that is rotatably mounted to the upper left extension 124 or upper right extension 128. A mounting plate 140 is fixedly secured to a bottom surface of the armrest 134 in the same manner as described above for the lower rail 130.

Figure 13:
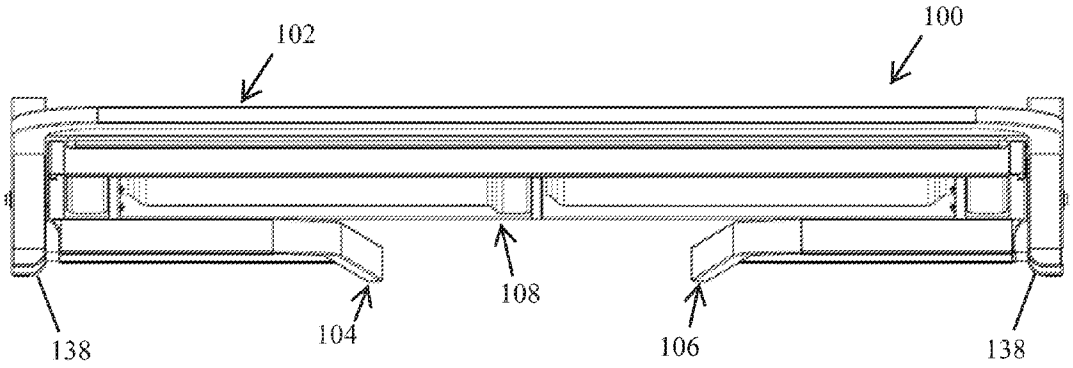
FIG. 13 is a top plan view of a foldable bench in a folded configuration according to an embodiment of the present invention.
Figure 14:
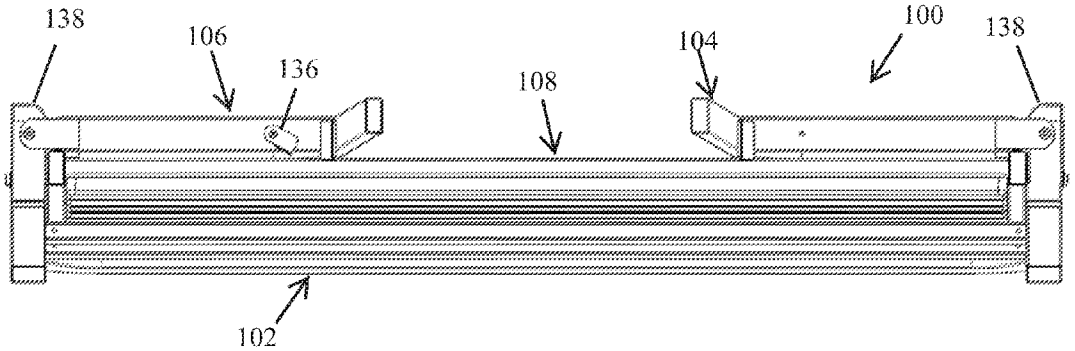
FIG. 14 is a bottom plan view of a foldable bench in a folded configuration according to an embodiment of the present invention.
Figure 15:
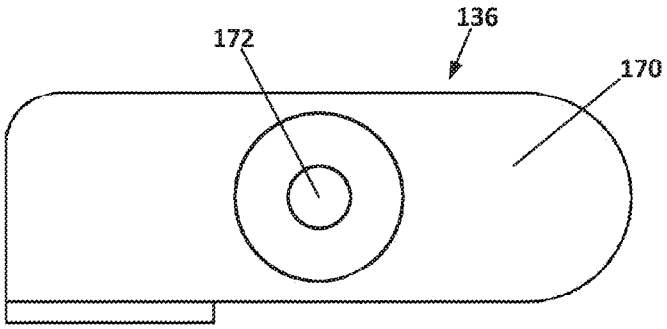
FIG. 15 is a front elevation view of a latch according to an embodiment of the present invention.
Figure 16:
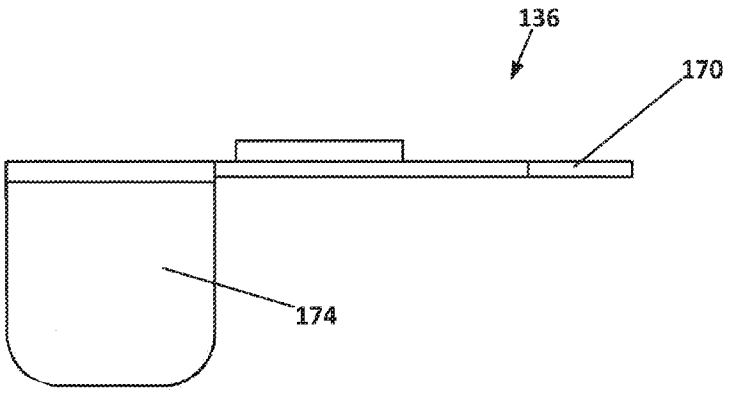
FIG. 16 is a top plan view of a latch according to an embodiment of the present invention.
Figure 17:
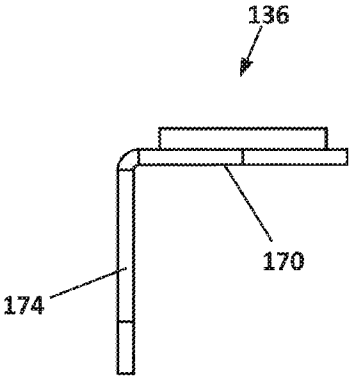
FIG. 17 is a right side elevation view of a latch according to an embodiment of the present invention.
Figure 18:
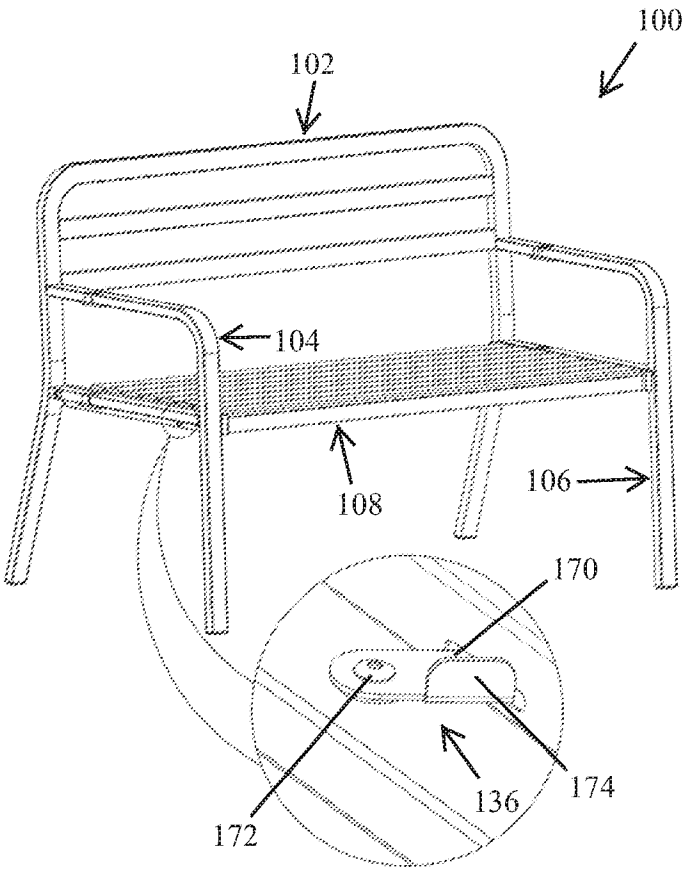
FIG. 18 is a front perspective view of a foldable bench in an unfolded configuration and including a detail view of a latch mechanism in a latched position according to an embodiment of the present invention.

The seat 108 is rotatably mounted adjacent the front surface 110 of the backrest 102 and extends between the first and second sides of the backrest. As shown in FIG. 13, in the folded position, the seat 108 is rotated upwards and is positioned parallel with and immediately adjacent to the backrest 102. After the seat 108 has been rotated upwards, the left and right front support members 104, 106 are then rotated inwards to the folded position such that they are parallel with the backrest 102. In the folded position, the seat 108 is sandwiched between the backrest 102 and the front support members 104, 106.

Figure 7:
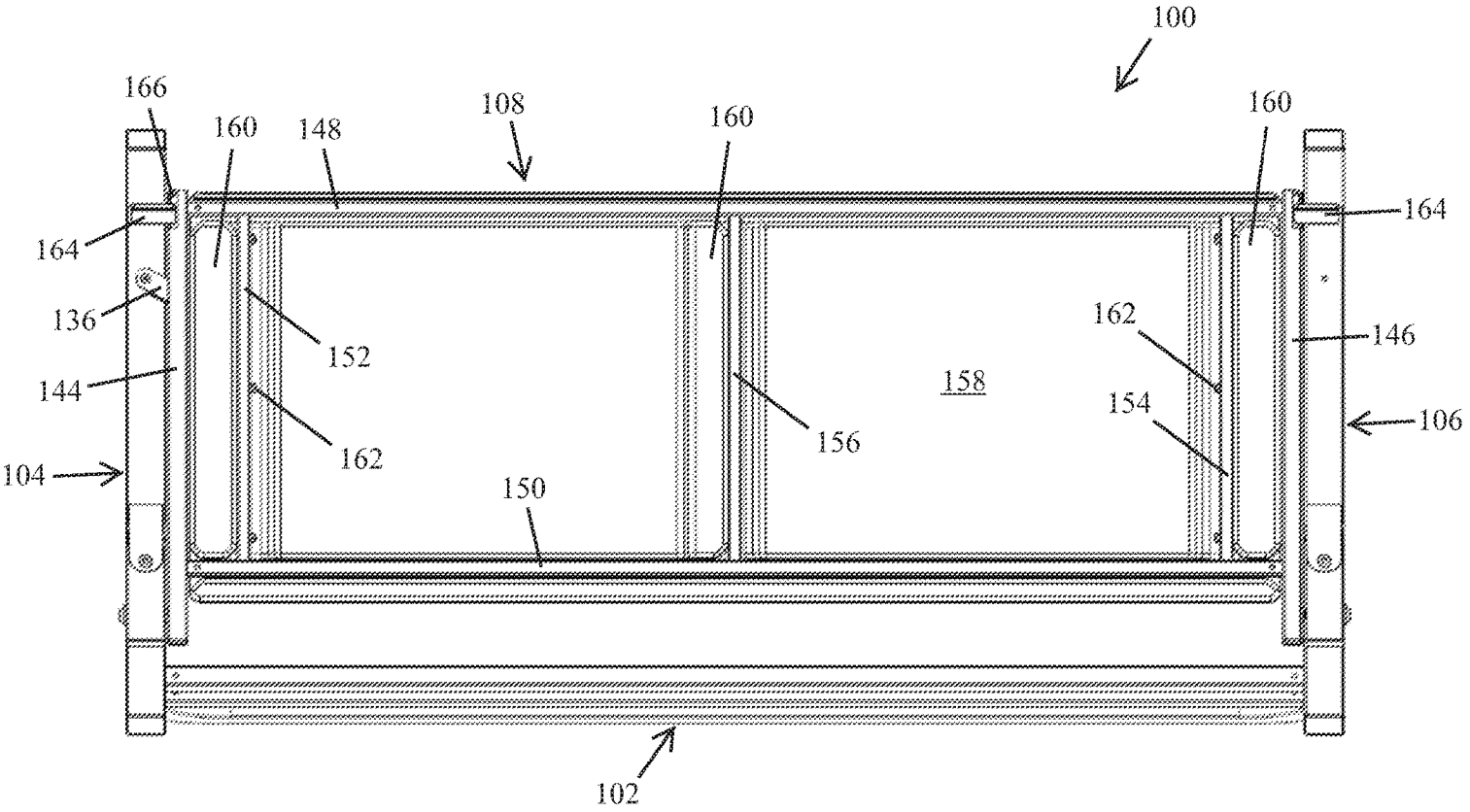
FIG. 7 is a bottom plan view of a foldable bench in an unfolded configuration according to an embodiment of the present invention.

With reference to FIG. 7, the seat 108 includes a seat support frame and a seat top 158, which may be formed from blow molded plastic. The seat top includes a top surface, where an occupant of the bench 100 would sit, and a bottom surface, which is mounted to the seat support frame. The seat top 108 may include one or more downward projections 160 that may be connected to the seat support frame by connectors. As discussed in greater detail below, connectors pass through seat support frame and into one of the downward projections 160 to connect the seat support frame to the seat top 108.

The seat support frame extends between the first and second front support members 104, 106 that are rotatably mounted to the backrest 102. The seat frame has a first side and a second side and an open middle defined by a first side member 144 and a second side member 146. The frame 144 also includes a front member 148 and a back member 150 that are connected between the first and second side members 144, 146. Also, in certain embodiments, one or more middle supports connected to the front and back members 148, 150 are located between the first and second side members 144, 146. In this particular embodiment, a first middle support 152 is spaced slightly apart from the first side member 144 such that an opening is formed between the first middle support and the first side member. Similarly, a second middle support 154 is spaced slightly apart from the second side member 146 such that an opening is formed between the second middle support and the second side member. Lastly, a third middle support 156 is located in approximately the center of the seat 108 between the first and second side members 144, 146.

One function of the middle supports is to add additional rigidity and support to the seat 108. Another function of the middle supports is to provide a convenient attachment location for the downward projections 160 of the seat top 158. In the embodiment shown, downward projections 160 are positioned so that they may be inserted into the opening formed between the first middle support 152 and the first side member 144 as well as between the second middle support 154 and the second side member 146. Connectors 162 are inserted through the middle supports 152, 160 and then into the downward projections 160 to connect the seat support frame with the seat top 158. Another downward projection 160 is positioned alongside the third middle support 156 as well. In addition to providing a convenient mounting location, another added benefit of the downward projections is that they assist in correctly positioning the seat top 158 with respect to the seat support frame and with limiting movement of the seat top with respect to the seat support frame.

Figure 3:
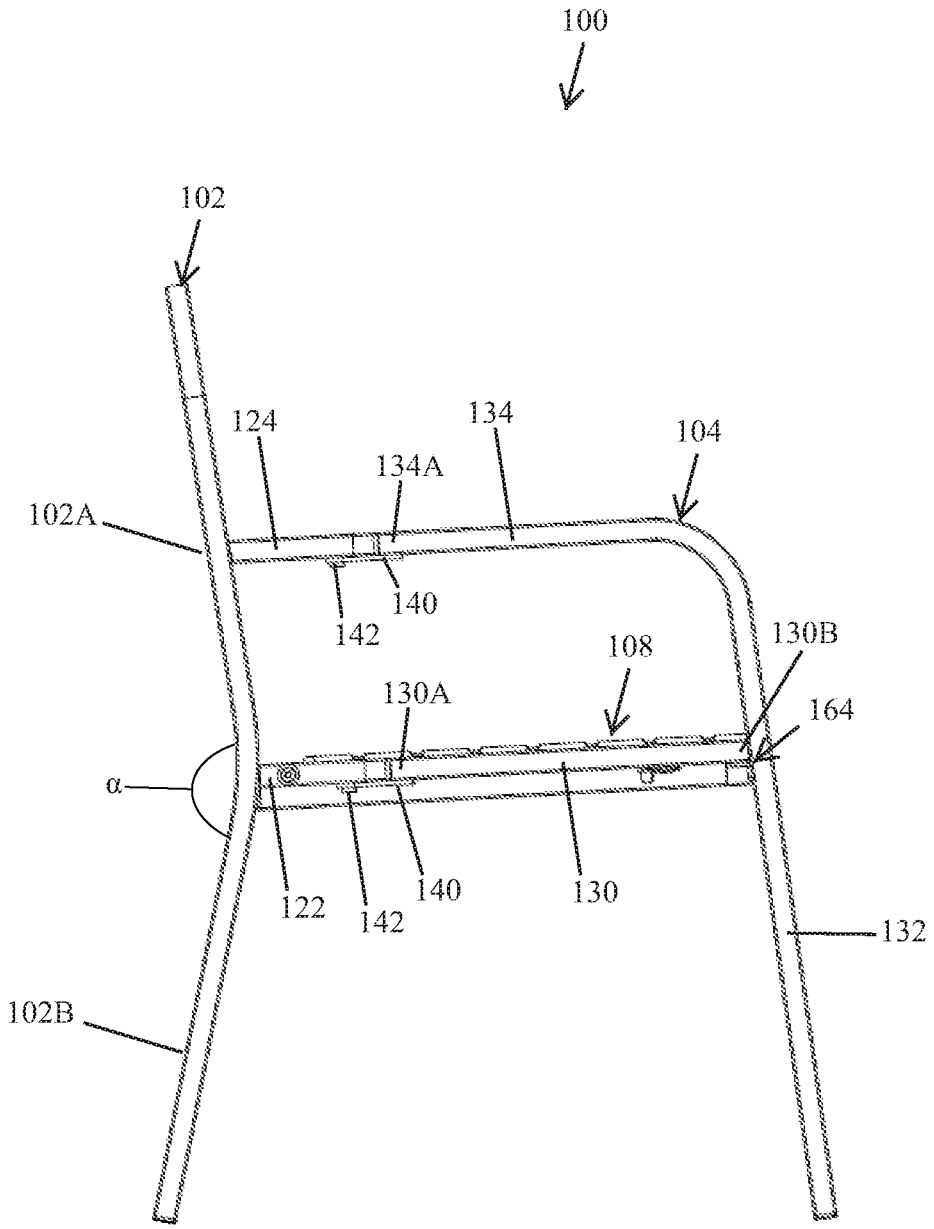
FIG. 3 is a left side elevation view of a foldable bench in an unfolded configuration according to an embodiment of the present invention.
Figure 4:
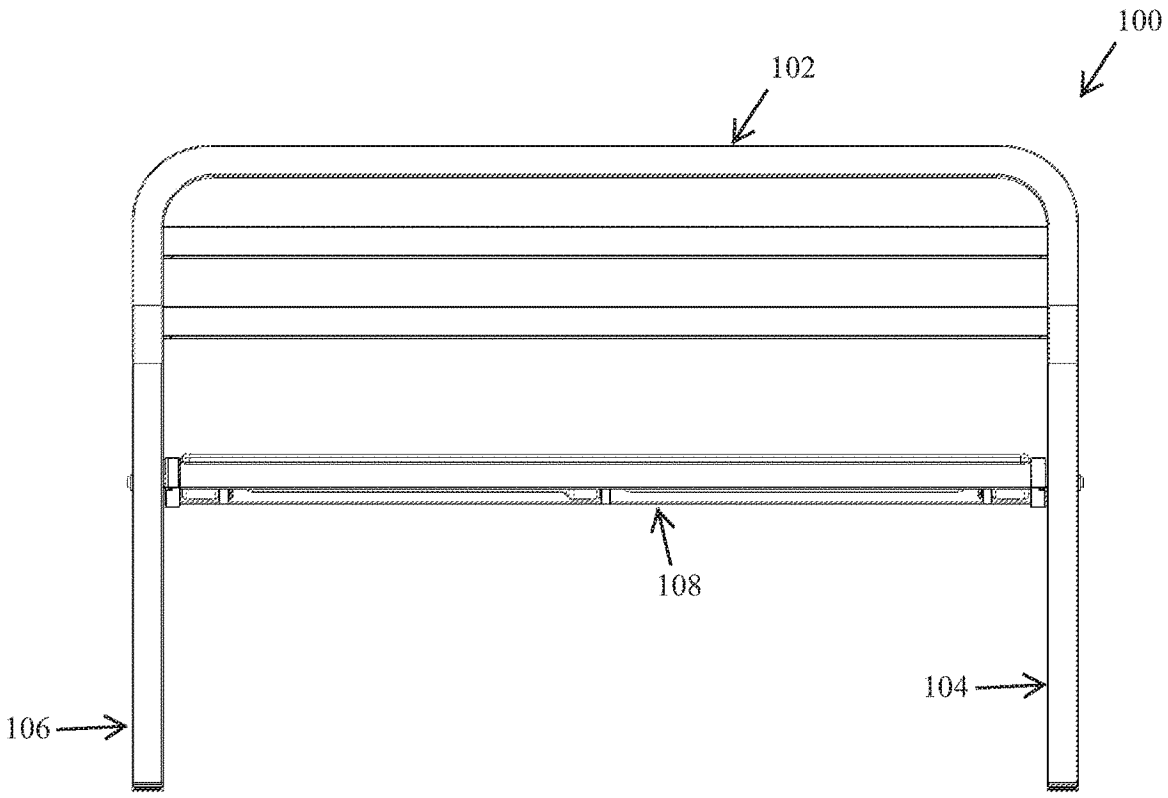
FIG. 4 is a rear elevation view of a foldable bench in an unfolded configuration according to an embodiment of the present invention.
Figure 5:
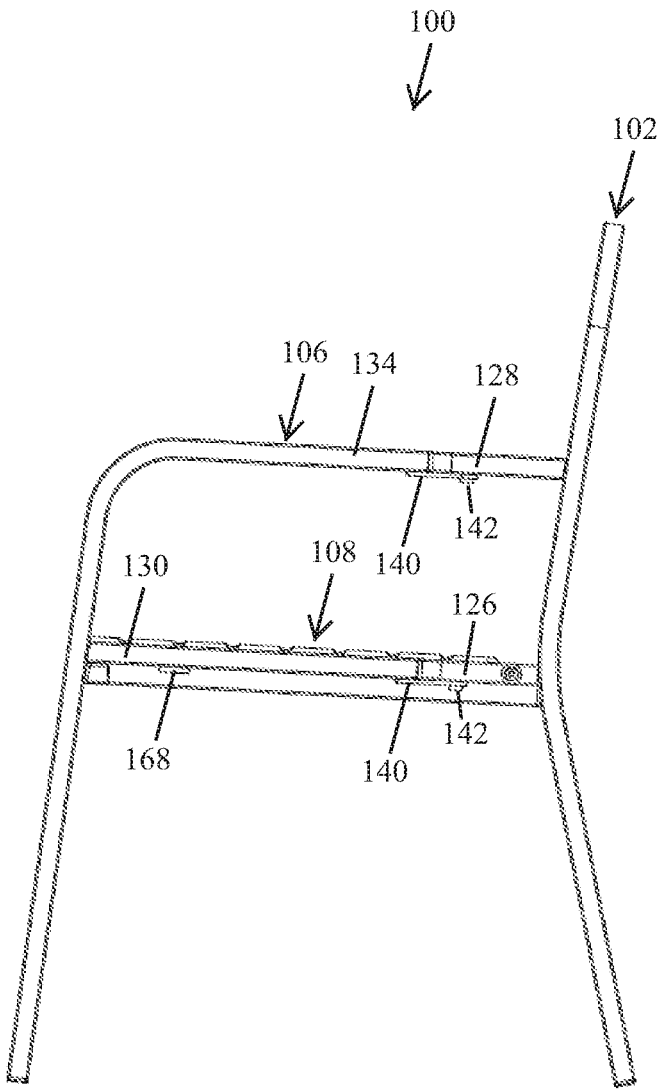
FIG. 5 is a right side elevation view of a foldable bench in an unfolded configuration according to an embodiment of the present invention.
Figure 6:
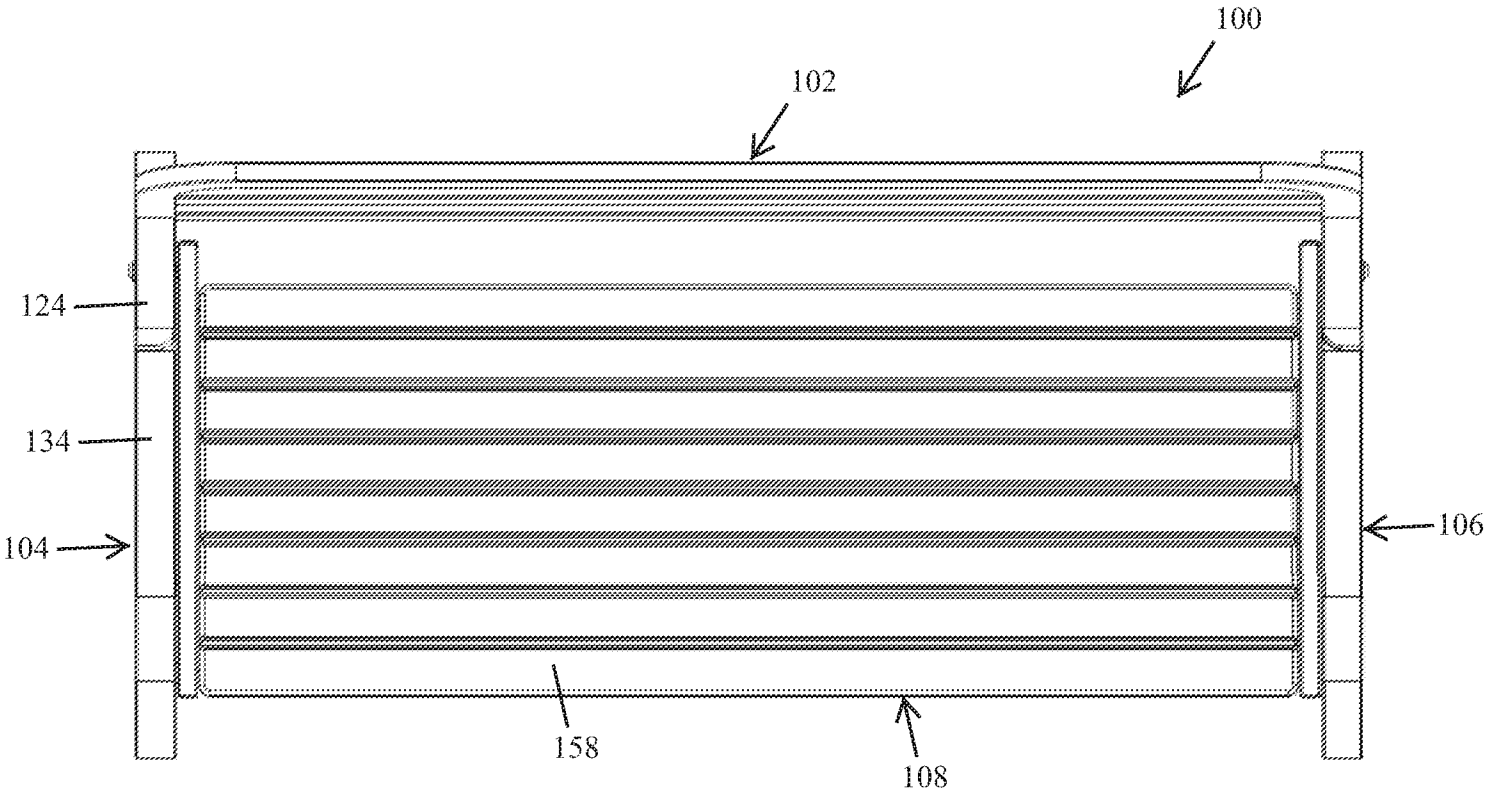
FIG. 6 is a top plan view of a foldable bench in an unfolded configuration according to an embodiment of the present invention.

The seat 108 is supported in the unfolded position by one or more seat supports 164 that are fixed mounted to and extend away from the first or second front support members 104, 106. In this particular embodiment, seat supports 164 are mounted to a bottom surface of the lower rail 130 of first front support member 104 and of the second front support member 106. The seat support 164 may comprise a bar or a rod-like extension that extends inwards from the front support members 104, 106. Referring to FIGS. 1 and 3, in this particular embodiment, the seat support 164 forms an elongate L having a top and a side connected together at an angle. The top of the seat support 164 is mounted to the bottom surface of the lower horizontal rail 130 of the first and second front support members 104, 106. The side of each seat support 164 is mounted to a rearward-facing surface of the legs 132 of the first and second front support members 104, 106.

A free end of each seat support 164 is received by a receiver that is disposed in or on a side surface of the seat 108. In certain embodiments, a receiver, such as a U-shaped bracket or even a flat plate, is mounted to an outside surface along the left or right sides of the seat 108. In the embodiment shown, a cutout 166 is formed in the left and right sides of the seat that receives the seat support 164. In either case, the receiver is configured to contact a top of the seat support 164 when the seat is rotated to the unfolded position for supporting the seat in the unfolded position.

Lastly, the latch 136 is used to hold the seat 108 in the unfolded orientation. In this particular embodiment, a rotating latch 136 is mounted to the first or second front support member 104, 106 and is designed to selectively engage a latch opening 168 formed in the side surface of the seat 108. In other embodiments, other types of latches, such as a deadbolt or spring latch, may be used in place of the rotating latch. A latch opening 168 may be placed on either side of the bench 100 so that the placement of the latch 136 may be changed as desired. A rotatable latch 136, shown in FIG. 15, has a latch extension 170 that is configured to engage the latch opening 168. The rotatable latch 136 is mounted to the left and right front support member 104, 106 by passing a connector through an opening 172 in the latch. A thumb button 174 located opposite from the latch extension 170 may be pressed by a user to easily turn the latch between a latched and an unlatched position.

In the embodiments discussed above, the first and second front support members 104, 106 include an armrest. However, in other embodiments, such as a chair or stool configuration, there is no armrest. Still, the device folds in the same manner as described above. In these alternative embodiments, rails connecting the front supports to the back rest are located at seat level and below seat level. These rails are rotatably mounted and allow the front supports to be rotated inwards to a folded position.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A foldable chair comprising:

a backrest having a front surface, a back surface, a first side, and a second side;

a first front support member rotatably mounted to the backrest proximate the first side, the first front support member configured to rotate between a folded position where the first front support member is disposed adjacent to the backrest and an unfolded position where the first front support member extends outwardly from the backrest, wherein the first front support member comprises:

a first front leg having a rearward-facing surface and a substantially horizontal first lower rail having a bottom surface, a first end that is rotatably mounted to the first side of the backrest, and a second end that is fixedly mounted to the first front leg;

a second front support member rotatably mounted to the backrest proximate the second side, the second front support member configured to rotate between a folded position where the second front support member is disposed adjacent to the backrest and an unfolded position where the second front support member extends outwardly from the backrest, wherein the second front support member comprises:

a second front leg having a rearward-facing surface: and a substantially horizontal second lower rail having a bottom surface, a first end that is rotatably mounted to the first side of the backrest, and a second end that is fixedly mounted to the second front leg;

a seat having opposing first and second side surfaces, the seat extending between the first and second front support members and rotatably mounted to the backrest and configured to rotate between a folded position where the seat is disposed adjacent to the backrest and an unfolded position where the seat extends outwardly from the backrest;

a first seat support extending from the first front support member, the first seat support comprising an elongate first L-shaped member having a top and a side connected together at an angle, wherein:

the top of the first L-shaped member is affixed to the bottom surface of the first lower rail of the first front support member; and the side of the first L-shaped member is affixed to the rearward-facing surface of the first front leg;

a second seat support extending from the second front support member, the second seat support comprising an elongate second L-shaped member having a top and a side connected together at an angle, wherein:

the top of the second L-shaped member is affixed to the bottom surface of the second lower rail of the second front support member; and the side of the second L-shaped member is affixed to the rearward-facing surface of the second front leg;

a first receiver disposed on a in the first side surface of the seat and configured to receive an extension of the first L-shaped member when the seat is rotated to the unfolded position for supporting the seat in the unfolded position; and a second receiver disposed in the second side surface of the seat and configured to receive an extension of the second L-shaped member when the seat is rotated to the unfolded position for supporting the seat in the unfolded position, and a latch mounted to the first or second front support member and having a latch extension; and a latch receiver disposed in a side surface of the seat and configured to receive the latch extension when the seat is in the unfolded position to prevent the seat from rotating with respect to the backrest.

2. The foldable chair of 1 wherein the seat includes:

a seat support frame extending between the first and second front support members that is rotatably mounted to the backrest and configured to rotate vertically between the folded position and the unfolded position; and a seat top mounted to a top surface of the seat support frame.

3. The foldable chair of claim 2 wherein the seat top is formed from blow molded plastic.

4. The foldable chair of claim 2 wherein the seat support frame has a first side and a second side and an open middle defined by front and back members, a first side member and a second side member connected to the front and back members proximate the first and second side, respectively, and at least one middle support member connected to the front and back members and located between the first and second side members.

5. The foldable chair of claim 4 wherein the seat top comprises a downward projection that is connected to the seat support frame by connectors that pass through seat support frame and into the downward projection to connect the seat support frame to the seat top.

6. The foldable chair of claim 2 further comprising:

a seat frame having a first side and a second side and an open middle defined by front and back members, first and second side members connected to the front and back members and located at the first and second sides of the seat frame, respectively, and first and second middle supports connected to the front and back members proximate the first and second sides of the seat frame, respectively; and a first downward projection of the seat top extending into the open middle of the support frame between the first side member and the first middle support;

a second downward projection of the seat top extending into the open middle of the support frame between the second side member and the second middle support;

connectors passing through the first middle support and into the first downward projection and through the second middle support and into the second downward projection to connect the seat support frame to the seat top.

7. The foldable chair of claim 1 wherein the first front support member is rotatably mounted to a first extension extending outwards from the backrest and the second front support member is rotatably mounted to a second extension extending from the backrest.

8. The foldable chair of claim 7 wherein an inside corner of the first and second extensions is rounded.

9. The foldable chair of claim 7 wherein the first front support and the second front support each have an arm rest and a lower horizontal rail that is rotatably mounted to corresponding upper and lower first and second extensions extending outwards from the backrest.

10. The foldable chair of claim 1 wherein the latch is mounted to a bottom surface of the first lower rail of the first front support member and the latch extension is disposed parallel to the bottom surface.

11. The foldable chair of claim 1 wherein the latch is a rotating latch and the latch extension is configured to pivot in a plane that is parallel to the bottom surface of the first lower rail to selectively engage the latch receiver when the latch is rotated.

12. The foldable chair of claim 1 wherein the latch receiver is an opening disposed in the first side surface of the seat that is configured to receive the latch extension.

* * * * *